US007001133B2

(12) United States Patent
Muramoto

(10) Patent No.: US 7,001,133 B2
(45) Date of Patent: Feb. 21, 2006

(54) WORKING VEHICLE WITH A FRONT-END LOADER, AND BOOM ASSEMBLY OF THE FRONT-END LOADER

(75) Inventor: Naoya Muramoto, Sakai (JP)

(73) Assignee: Kubota Corporation, Osaka (JP)

( * ) Notice: Subject to any disclaimer, the term of this patent is extended or adjusted under 35 U.S.C. 154(b) by 202 days.

(21) Appl. No.: 10/393,381

(22) Filed: Mar. 20, 2003

(65) Prior Publication Data

US 2003/0223851 A1 Dec. 4, 2003

(30) Foreign Application Priority Data

Mar. 27, 2002 (JP) ..... 2002-087362
Mar. 27, 2002 (JP) ..... 2002-087363

(51) Int. Cl.
*E02F 9/00* (2006.01)

(52) U.S. Cl. ..... 414/686; 172/275

(58) Field of Classification Search ..... 414/686, 414/685, 722; 172/274, 275; 52/116; 29/897.2, 29/897.312

See application file for complete search history.

(56) References Cited

U.S. PATENT DOCUMENTS 5,248,237 A * 9/1993 Nakamura ..... 414/686

FOREIGN PATENT DOCUMENTS

JP 11-120015 * 11/2000

* cited by examiner

*Primary Examiner*—Donald W. Underwood
(74) *Attorney, Agent, or Firm*—The Webb Law Firm

(57) ABSTRACT

A working vehicle with a front-end loader comprises:

a vehicle body;

a right and left pair of support decks each extending transversely of the vehicle body and fixed at an inward end thereof to the vehicle body;

boom supporting members each erected on an outward end of one of the support decks;

a boom pivotably connected at one end thereof to upper positions of the boom supporting members and having a working implement attached to the other end thereof;

a boom cylinder extending between one of the boom supporting members and the boom for swinging the boom;

mounting elements each provided for one of the boom supporting members and partially protruding outward from the one of the boom supporting members; and connecting frames each fixed at one end thereof to the vehicle body, and fixed at the other end thereof to one of the mounting elements.

12 Claims, 14 Drawing Sheets

41
44a
44b
44b
43d
44c
40
43a
43b
43a
45
32
13

43b
43a
43c
43a 43b
44b
44c
43a
44b 44b
43a
43c
43d
44b
43a

WORKING VEHICLE WITH A FRONT-END LOADER, AND BOOM ASSEMBLY OF THE FRONT-END LOADER

BACKGROUND OF THE INVENTION

1. Field of the Invention

The present invention relates to a working vehicle with a front-end loader and to a boom assembly of the front-end loader.

2. Description of the Related Art

This type of working vehicle includes a tractor with a front-end loader mounted forwardly thereof. The tractor includes support decks protruding laterally outwardly from a front portion of a vehicle body, and boom supporting members extending upward from the support decks, respectively. The front-end loader includes a boom having a proximal end pivotally connected to the boom support members and a distal end having a bucket attached thereto. A boom cylinder is disposed between the boom and one of the boom supporting members. Braces extend between a front axle frame protruding forwardly of an engine and upper portions of the boom supporting members.

However, with this conventional working vehicle, the braces are positioned laterally of a tractor hood, which are obstructive to maintenance of the hood interior, hinders the driver's forward vision, and impairs an outward appearance.

In order to overcome the above drawbacks, Japanese Patent Unexamined Publication No. 2000-309940 proposes a working vehicle dispensing with the braces and yet securing the strength of the boom supporting structure. This conventional working vehicle includes support decks protruding laterally outwardly from a front portion of a vehicle body, and boom supporting members extending upward from the support decks, respectively. The boom supporting members support a proximal end of a boom having a working implement attached to a distal end thereof. A boom cylinder is disposed between the boom and one of the boom supporting members for swinging the boom. Connecting frames are arranged laterally of the vehicle body and fixed to the support decks and the vehicle body. Reinforcing members fixedly extend between the connecting frames and boom supporting members. Such a working vehicle is useful to some extent in that the support decks and vehicle body are interconnected through the connecting frames, and the reinforcing members are is fixed between the connecting frames and boom supporting members, thereby to secure strength without using braces.

However, the reinforcing members are required between the connecting frames and boom supporting members, and further various reinforcing elements are provided in other parts of the construction, which considerably increases the number of parts. In addition, these numerous reinforcing elements are joined by welding, resulting in an increased number of manufacturing processes to increase the cost. Further, the reinforcing elements protrude from plural positions, which presents a somewhat confused, untidy outward appearance, and constitutes a low quality of design.

SUMMARY OF THE INVENTION

The present invention has been made having regard to the state of the art as noted above, and its object is to simplify the connecting structure between the connecting frames and boom supporting members while securing enough strength.

It is also an object of the invention to simplify the pivotal connecting structure between the boom and boom supporting members.

In order to fulfill the above-noted objects, the present invention provides a working vehicle with a front-end loader, comprising:

a vehicle body;

a right and left pair of support decks each extending transversely of the vehicle body and fixed at an inward end thereof to the vehicle body;

boom supporting members each erected on an outward end of one of the support decks;

a boom pivotably connected at one end thereof to upper positions of the boom supporting members and having a working implement attached to the other end thereof;

a boom cylinder extending between one of the boom supporting members and the boom for swinging the boom;

mounting elements each provided for one of the boom supporting members and partially protruding outward from the one of the boom supporting members; and connecting frames each fixed at one end thereof to the vehicle body, and fixed at the other end thereof to one of the mounting elements.

With this construction, each boom supporting member and vehicle body are directly interconnected through the connecting frame and the mounting element. This construction is strong enough to withstand a load applied from the boom, and realizes a simple arrangement having the mounting element for the connecting frame disposed on the boom supporting member.

The mounting element preferably protrudes downwardly of the boom supporting member. With this, the connecting frame connected to an underside of the boom supporting member advantageously acts as reinforcement against the load applied from the boom connected the upper portion of the boom supporting member.

It is also preferable that the boom supporting member includes right and left pair of side walls, and the mounting element is formed by extending at least one of the right and left side walls downwardly. With this construction, it is not necessary to join the mounting element to any separate component by welding, which facilitates manufacture and also curtails cost.

It is further preferable that the support deck is a pipe element having a greater thickness than a plate member constituting the boom supporting member. This arrangement can remarkably enhance the strength of the support deck and also dispense with any reinforcing elements, thereby to simplify the construction.

Further, a front-end loader mounted on a working vehicle according to the present invention comprises a right and left pair of support decks each extending transversely of a vehicle body and fixed at an inward end thereof to the vehicle body, a boom having a working implement attached to one end thereof, and boom supporting members each erected on an outward end of one of the support decks, each boom supporting member including a main frame fixed to the support deck and a sub-frame detachably attached to the main frame, in which the boom includes a boom pivotal supporting portion connected to the sub-frame through a pin, the boom pivotal supporting portion having;

(a) a pair of first walls opposed to each other, (b) second walls provided between the first walls, (c) a boss portion bridging the pair of first walls, and (d) reinforcing pieces integrally formed with the second walls at end portions thereof and bent from the second walls toward the boss portion.

Such a construction of the front-end loader, particularly with the construction of the boom pivotal supporting portion as noted above employed, dispenses with a process for joining the second walls to the reinforcing pieces by welding. It is required only to join the reinforcing pieces and the boss portion at butting positions therebetween by welding, which can reduce the number of parts as well as joints, thereby to decrease the number of manufacturing steps.

Other features and advantages of the invention will be apparent from the following detailed description of the preferred embodiments to be taken with reference to the accompanying drawings.

DESCRIPTION OF THE PREFERRED EMBODIMENT

Figure 1:
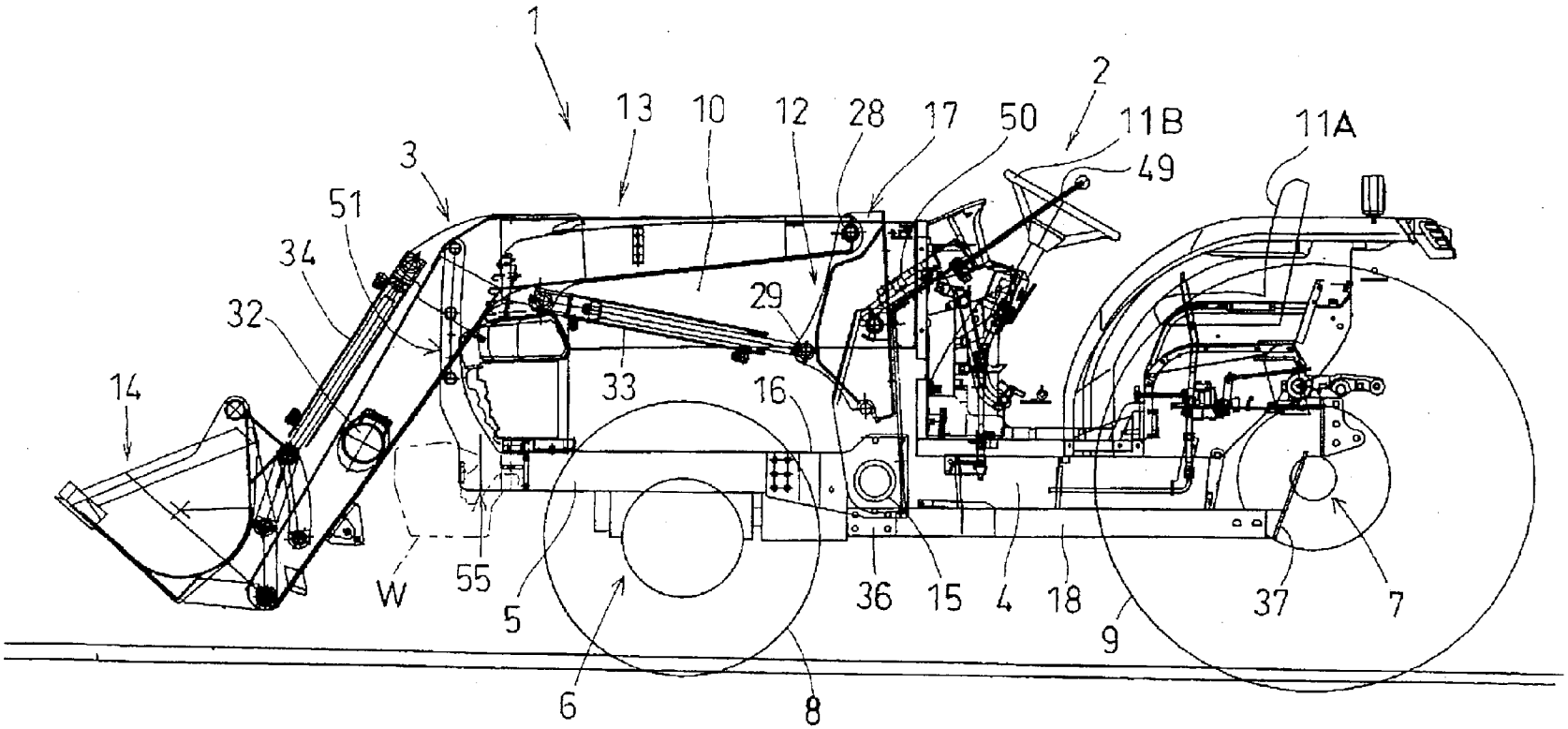
FIG. 1 is a side elevation of a working vehicle with a front-end loader according to the present invention.

Referring to FIG. 1, numeral 1 denotes a loader-mount working machine including a front-end loader 3 provided forwardly of a tractor (propelling vehicle) 2.

The tractor 2 includes a vehicle body 4 having an engine, a clutch housing, and a transmission case connected in a longitudinal direction, a front axle frame 5 fixed to an underside of the engine, front axle cases 6 and the like supported by the front axle frame 5, and rear axle cases 7 and the like fixed rearwardly of the transmission case. A right and left pair of front wheels 8 acting as dirigible wheels are attached to the front axle cases 6 through front axles, while a right and left pair of rear wheels 9 acting as drive wheels are attached to the rear axle cases 7 through rear axles.

The engine is housed in a front hood 10. A driver's seat 11A is mounted above a rear position of the vehicle body 4. A steering wheel 11B is provided forwardly of the driver's seat 11A.

Figure 2:
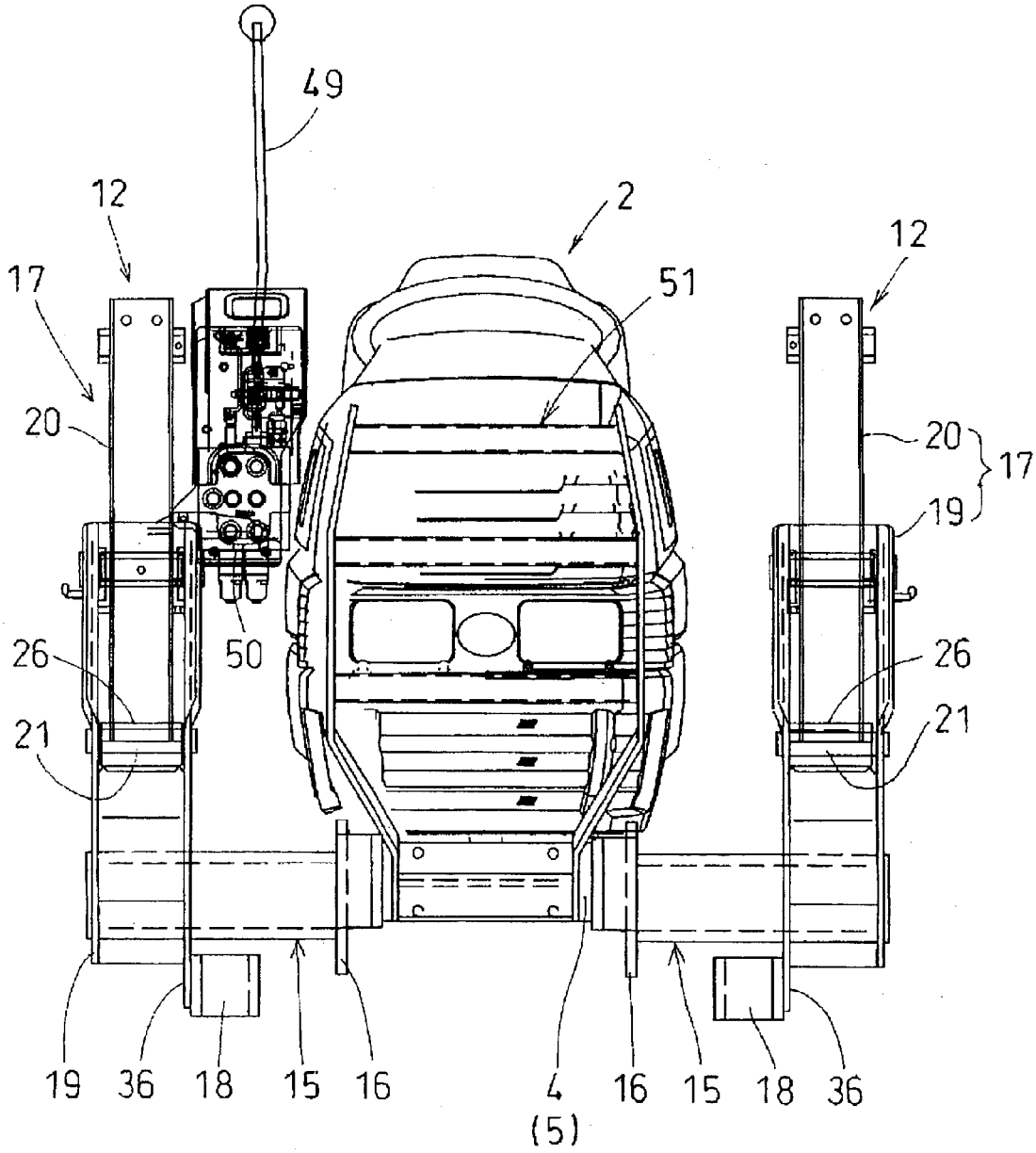
FIG. 2 is a front view of a boom supporting structure.
Figure 3:
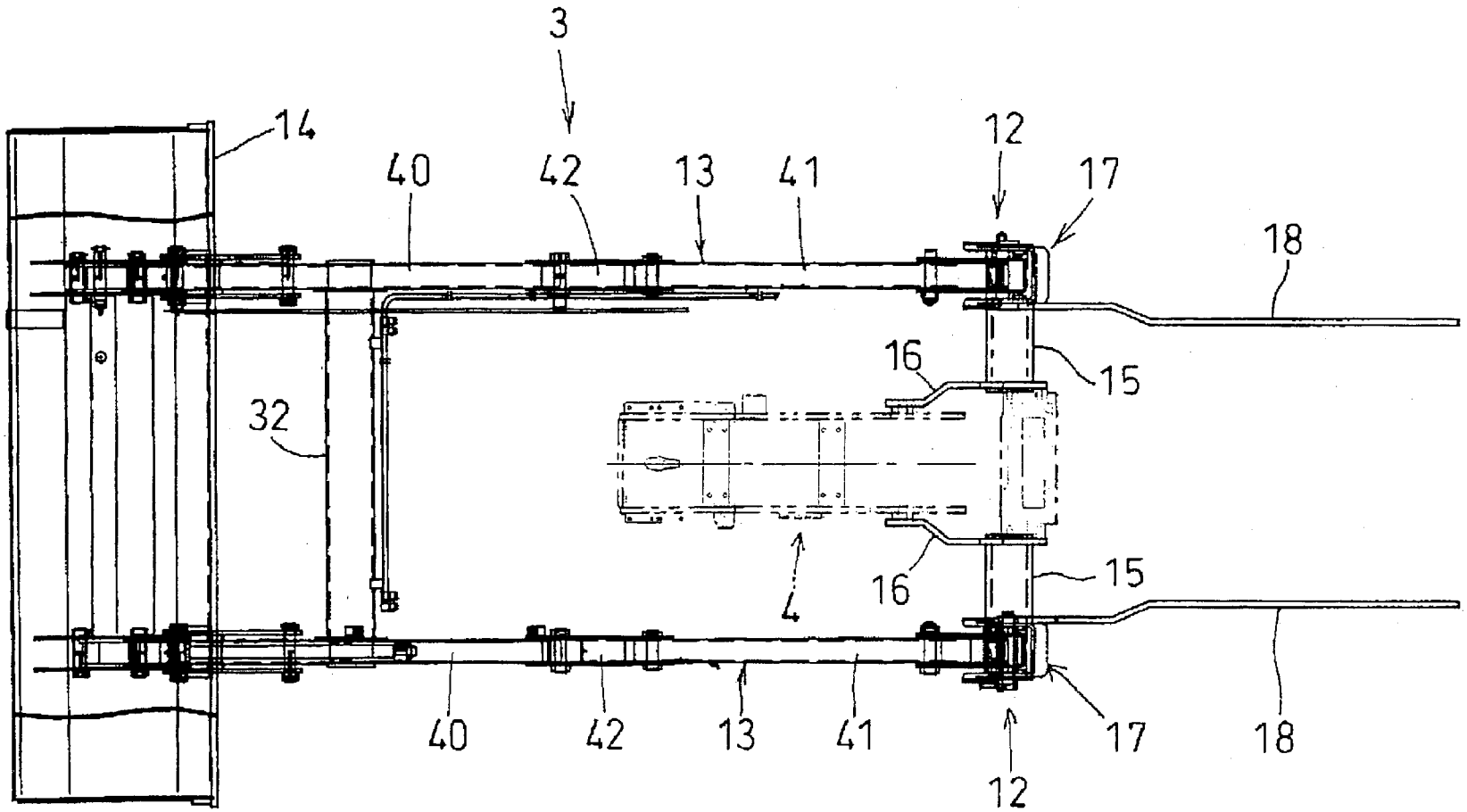
FIG. 3 is a plan view of a front-end loader.

As shown also in FIGS. 2 and 3, the front-end loader 3 includes frames 12, booms 13 and a bucket (working implement) 14.

The frames 12 are provided in a right and left pair, each including a support deck 15 protruding laterally outwardly from a forward portion of the vehicle body 4, an mounting bracket 16 for attaching and fixing the support deck 15 to the vehicle body 4, a boom supporting member 17 erected on the support deck 15, and a connecting frame 18 provided laterally of the vehicle body 4 to extend in the longitudinal direction and connected at a front end thereof to the supporting member 17 and at a rear end thereof to a rearward position of the vehicle body 4.

In this embodiment, each support deck 15 is a tubular pipe member having a transverse axis. The mounting bracket 16 is fixed such as by welding to a transversely inward end of the support deck 15. The mounting bracket 16 consists of a plate element or the like and is fixed by bolts to the vehicle body 4 such as the front axle frame 5.

The support deck 15 may be in the form of a square pipe.

The right and left mounting brackets 16 may be interconnected through an unillustrated coupling frame which in turn may be fixed to an underside of the vehicle body 4.

Figure 4:
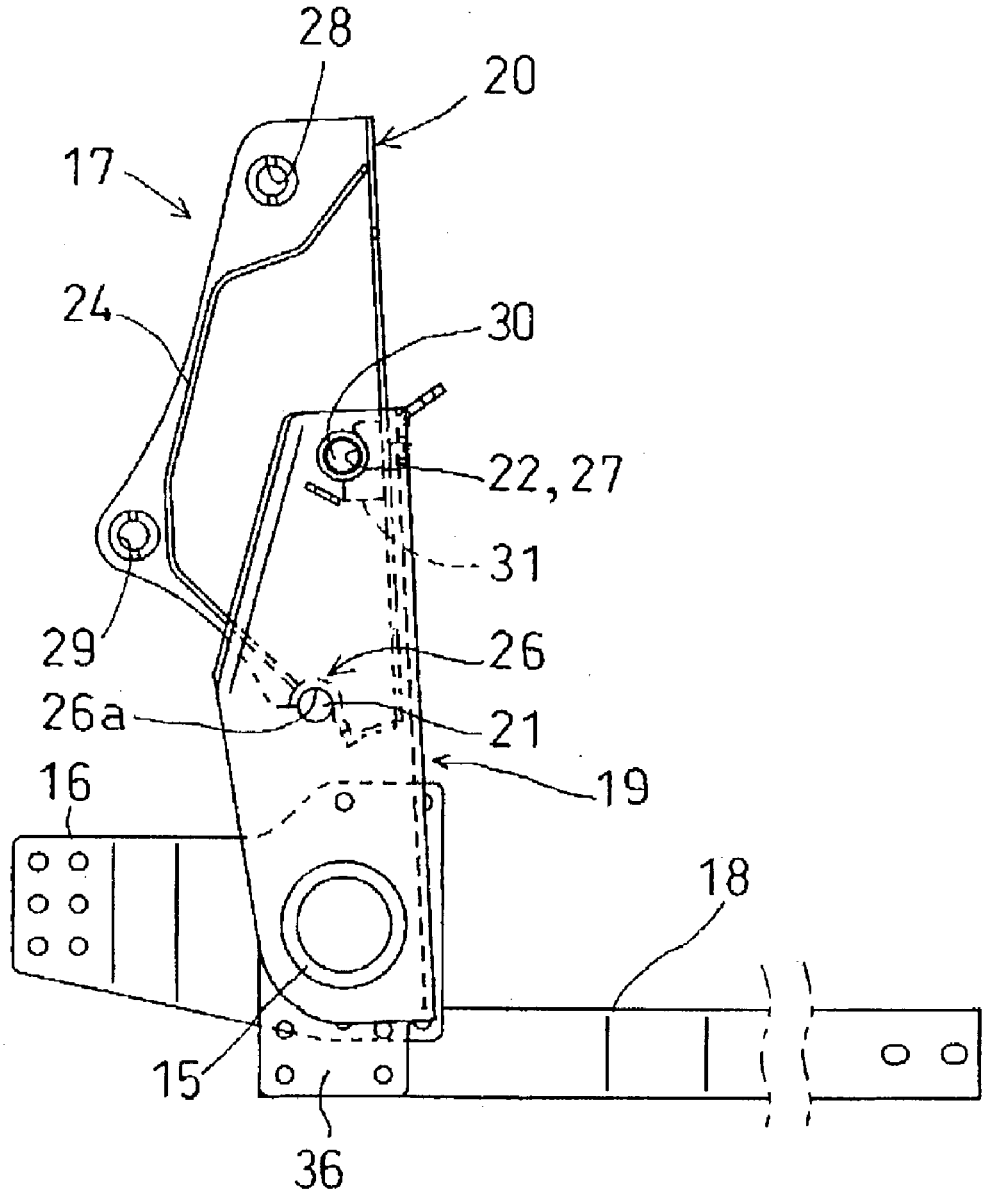
FIG. 4 is a side view of frames for supporting a boom.

As shown in FIG. 4, the boom supporting member 17 includes a main frame 19 fixed to a transversely outward end of the support deck 15, and a sub-frame 20 detachably attached to the main frame 19.

Figure 5:
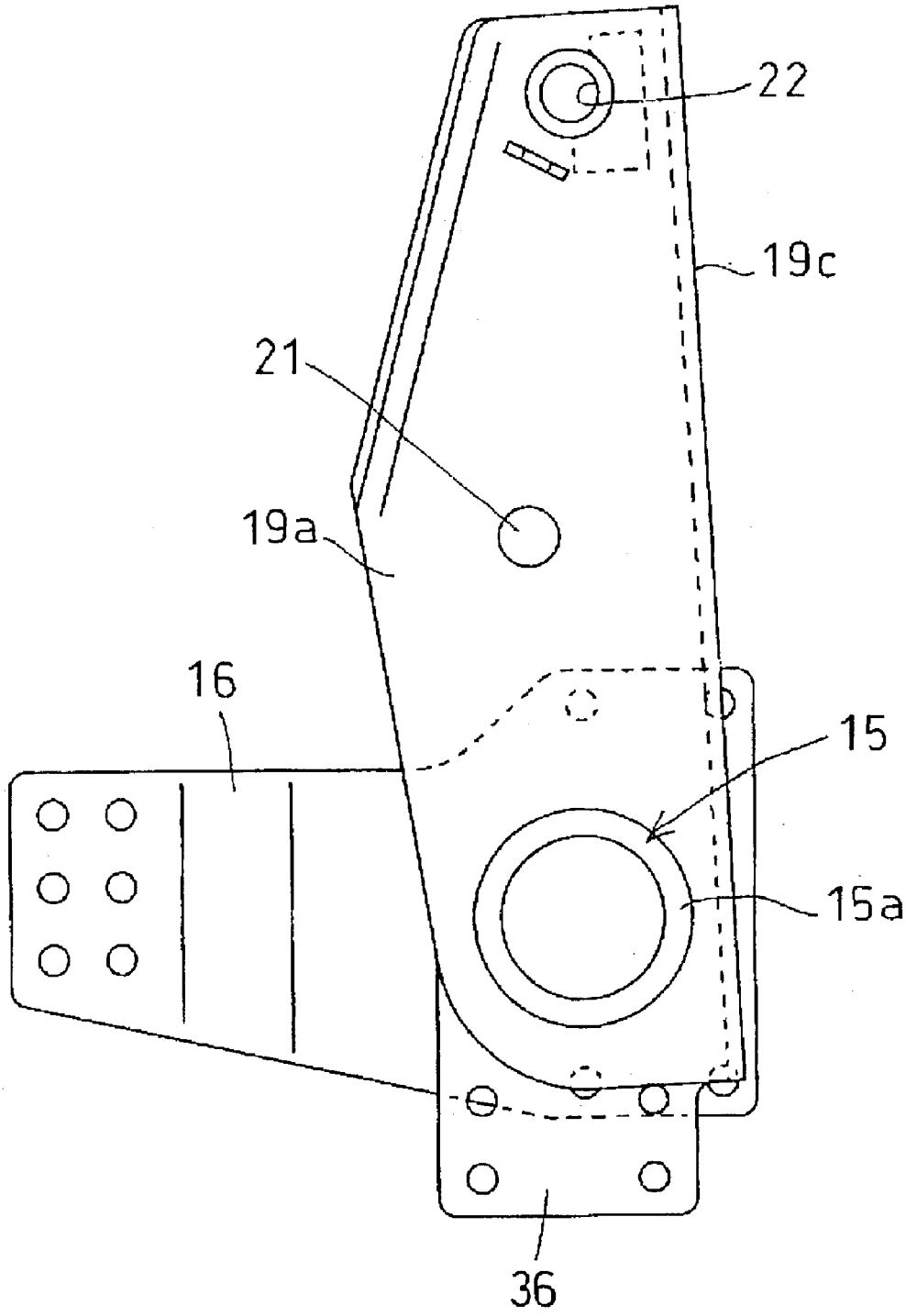
FIG. 5 is a side view of a left support deck, mounting bracket and boom supporting member (main frame)
Figure 6:
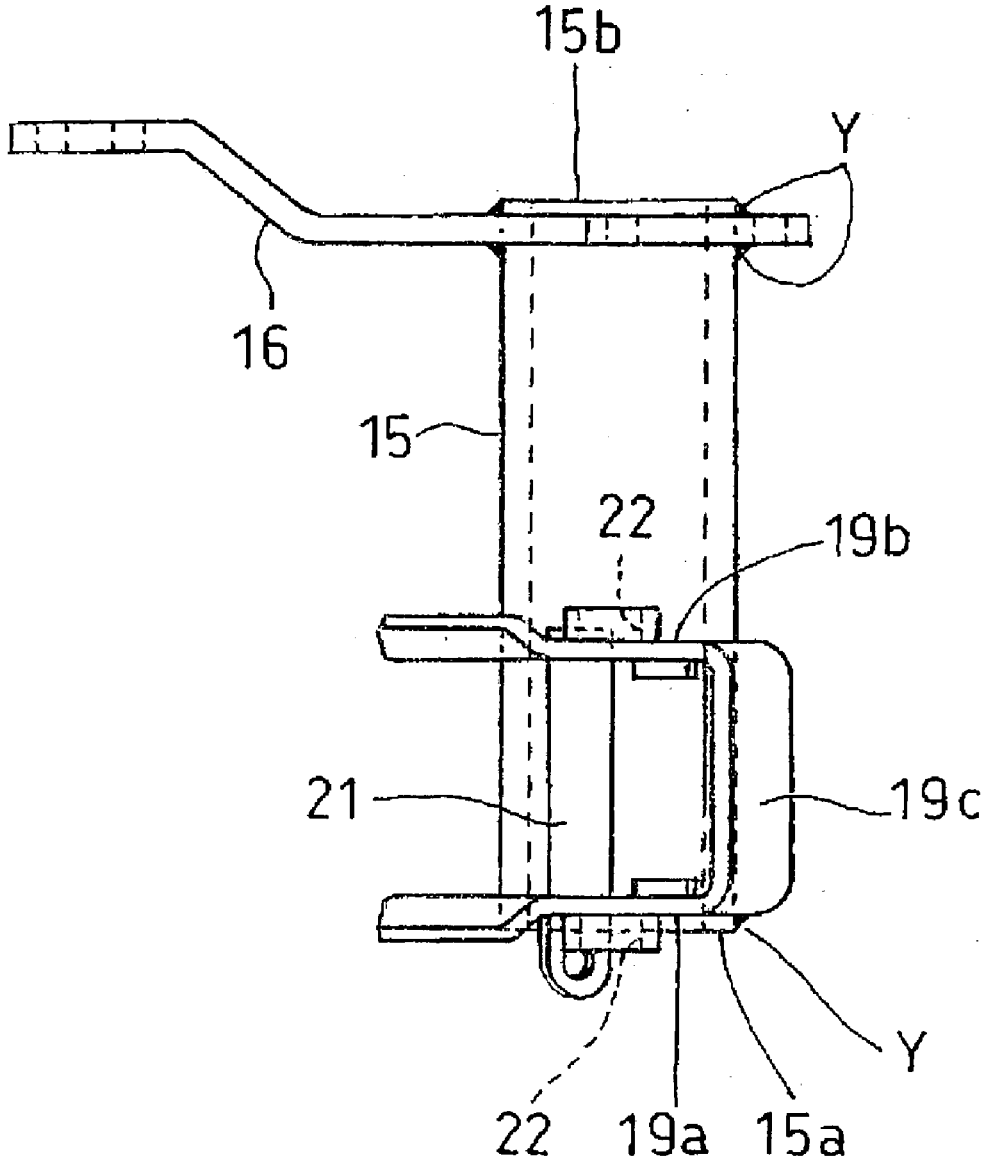
FIG. 6 is a plan view of the left support deck, mounting bracket and boom supporting member (main frame)
Figure 7:
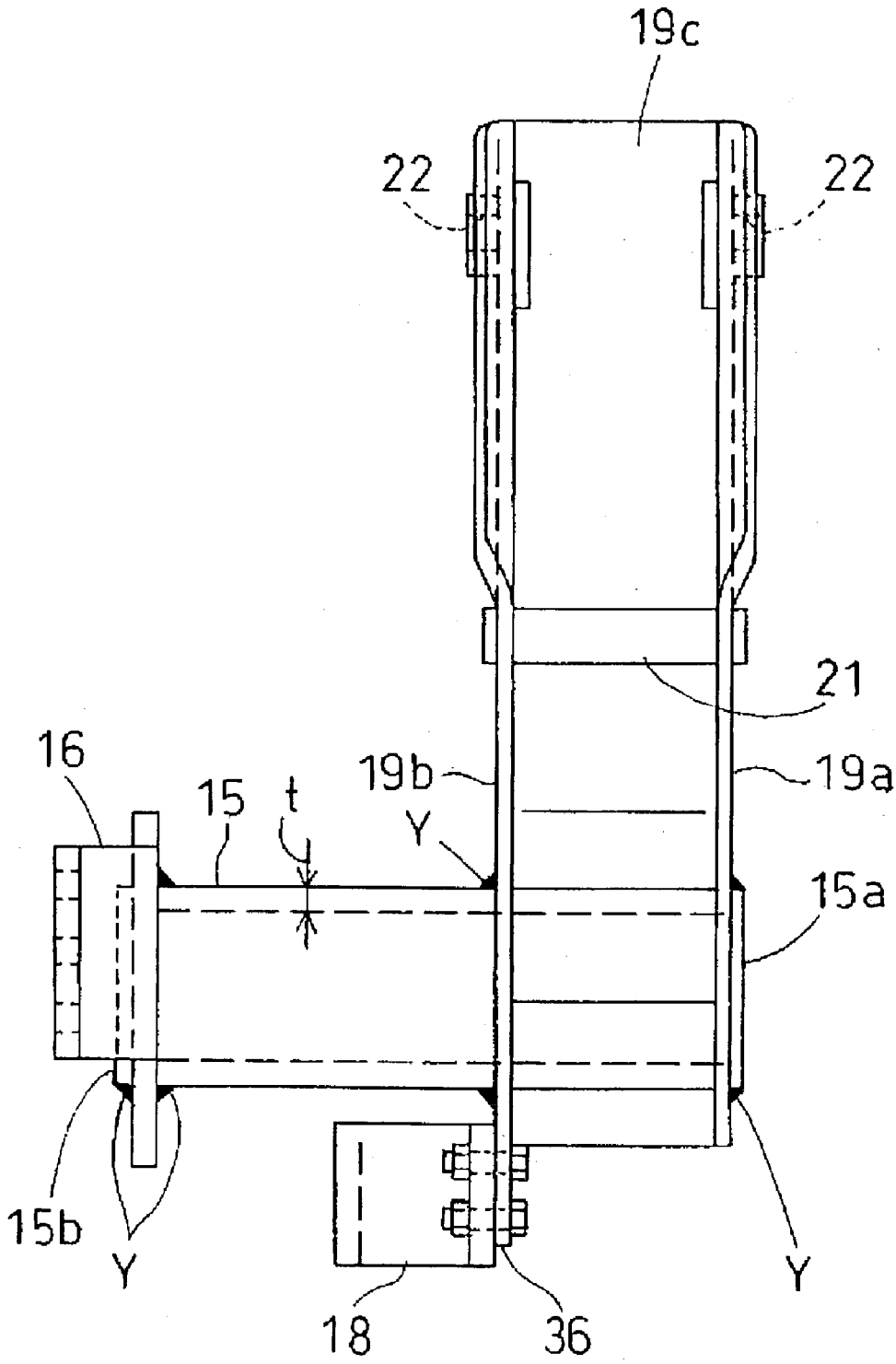
FIG. 7 is a front view of the left support deck, mounting bracket and boom supporting member (main frame)

Referring to FIGS. 5 through 7, the main frame 19 is in the form of a plate member bent into a channel-shaped section in plan view, to define right and left side walls 19*a* and 19*b* and a rear wall 19*c*. The main frame also has a transverse support shaft 21 extending between the right and left side walls 19*a* and 19*b* at a vertically intermediate, forward portion thereof, and receiving bores 22 formed in upper positions of the right and left side walls 19*a* and 19*b*.

As shown in FIG. 7, the transversely outward end portion of the support deck 15 extends through lower portions of the right and left side walls 19*a* and 19*b*. The outward end 15*a* of the support deck 15 protrudes from the outer side wall 19*a*. The support deck 15 has outer peripheries thereof joined by welding Y to outer surfaces of the right and left side walls 19*a* and 19*b* (i.e. the surfaces other than opposed surfaces of the right and left side walls 19*a* and 19*b*), thereby to increase the connecting strength between the support deck 15 and main frame 19.

The side walls 19*a* and 19*b* are joined at the outer surfaces thereof to the support deck 15 and not at the opposed surfaces thereof defining a narrow inner space therebetween, which facilitates a joining operation. Particularly, since the outward end 15*a* of the support deck 15 protrudes from the outer side wall 19*a*, these components are easily joined laterally outwardly of the main frame 19.

The support deck 15 extends through the main frame 19, and thus bears a load applied to the main frame 19 from the boom 13 at the outer peripheries of the support deck 15, thereby to enhance the load bearing capacity.

The support deck 15 transversely extends also through the mounting bracket 16 with a transversely inward end 15*b* thereof protruding from the mounting bracket 16. The support deck 15 is joined at outer peripheries thereof by welding Y to front and back sides of the mounting bracket 16.

The pipe member constituting the support deck 15 has a greater thickness t than the main frame 19, thereby to enhance the strength of the support deck 15 per se and dispense with various reinforcing elements. The mounting bracket 16 also employs substantially the same thick plate member as the support deck 15.

As shown in FIG. 4, the sub-frame 20 has a channel-shaped section opening forward in plan view and defining right and left side walls and a rear wall, reinforcing plates 24 and 25 extending between the right and left side walls, and fitting members 26 formed in lower forward positions of the right and left side walls. The fitting members 26 are in the form of arcuate recesses 26*a* opening downward.

The sub-frame 20 has receiving bores 27, 28 and 29 formed in upper positions and forward and rearward positions of vertically intermediate portions of the right and left side walls, respectively.

The recess 26*a* of the sub-frame 20 is fitted on the support shaft 21 of the main frame 19 from above. In this state, the receiving bores 27 formed in the rear positions of the vertically intermediate portion of the sub-frame 20 register with the receiving bores 22 of the main frame 19. A connecting pin 30 extends through the receiving bores 22 and 27, thereby to fix the sub-frame 20 to the main frame 19.

The sub-frame 20 is detachable from the main frame 19 by an operation reversed from the above. Thus, the front-end loader 3 is detachably attached to the tractor 2.

Boss guides 31 are provided on upper portions of inner surfaces of the right and left side walls 19*a* of the main frame 19 for receiving bosses disposed on edges of the receiving bores 27 formed in the outer surfaces of the sub-frame 20.

It is also possible to form the main frame 19 integrally with the sub-frame 20 of the boom supporting frame 17 so that the front-end loader 3 is undetachably fixed to the tractor 2.

Each connecting frame 18 is formed of an elongated plate member and arranged at a lower lateral portion of the vehicle body 4 to extend in the fore and aft direction.

The connecting frame 18 is bolted at a front portion thereof to a mounting element 36 formed by downwardly extending the transversely inward side wall 19*b* (facing the vehicle body 4) of the main frame 19, and at a rear portion thereof to the rear axle case 7 through a bracket 37 (see FIG. 1), thereby to be connected to the vehicle body 4.

Therefore, a load applied from the boom 13 to the boom supporting member 17 may be advantageously distributed to the connecting frame 18 directly connected to the boom supporting member 17, thereby to reduce stress acting on the joint between the boom supporting member 17 and support deck 15. The support deck 15 per se is thick and thus advantageously bears against bending and twisting forces due to a load applied from the boom 13.

Further, the boom 13 is connected to the upper position of the boom supporting member 17 above the support deck 15, while the connecting frame 18 is connected at the lower position of the boom supporting member 17 below the support deck 15. As a result, when a load is applied rearwardly from the boom 13 particularly, the connecting frame 18 receives a tensile load thereby to restrain twisting of the support deck 15.

Thus, the above-noted construction secures strength even in the absence of any braces used conventionally, and also simplifies the structure.

The mounting element 36 is integrally formed with the side wall 19*b* of the boom supporting member 17 which is extended downward, which can reduce the number of parts and facilitate manufacture thereof as compared with a mounting element formed as a separate element and joined to the supporting member by welding or the like.

The connecting frame 18 may be fixed at the rear end thereof directly to the vehicle body 4 or to any other members fixed to the vehicle body 4.

Where the tractor 2 is the type that can attach a backhoe assembly to the rear end thereof, the rear end of the connecting frame 18 may be connected and fixed to a backhoe attaching frame fixed to the rear axle case 7.

The mounting element 36 may be formed by downwardly extending the transversely outer side walls 19*a* of the main frame 19. Alternatively, two mounting elements 36 may be formed on both the right and left side walls 19*a* and 19*b* to which a forked connecting frame 18 or two connecting frames 18 is/are connected.

It is also possible to provide the mounting element 36 in the rear wall 19*c* of the main frame 19 to protrude rearward.

The strength of the frame 12 is enhanced by the arrangements having the connecting frame 18 directly connected to the underside of the boom supporting member 17, the support deck 15 with an increased thickness, and the support deck 15 extending through and protruding from the boom supporting member 17. It should be noted in particular that the main frame 19 of the boom supporting member 17 does not include any other reinforcement elements than the above-described elements, which realizes an extremely simple construction.

Referring to FIGS. 1 through 3, the booms 13 are provided in a right and left pair each pivotally connected at a proximal end (rear end) thereof to the sub-frame 20 to be swingable about a transverse axis through a pin extending through the receiving bores 28 of the sub-frame 20. The booms 13 are connected at distal ends thereof to the bucket 14 pivotable about a transverse axis.

The right and left booms 13 are interconnected at forward positions thereof by a connecting pipe 32.

A boom cylinder 33 is disposed between the boom supporting member 17 and boom 13. The boom cylinder 33 is pivotably supported at a rear end thereof by the sub-frame 20 through a pin extending through the receiving bores 29 of the sub-frame 20, and pivotably supported at a front end thereof to an intermediate position of the boom 13 through a pin. The boom 13 is swingable by extension and contraction of the boom cylinder 33.

A bucket cylinder 34 is disposed forwardly and upwardly of the boom 13. The bucket cylinder 34 is pivotally attached at a proximal end thereof to an intermediate position of the boom 13, and connected at a distal end thereof to the bucket 14 through a pair of links. The bucket 14 is operable for scooping and dumping soil and the like by extension and contraction of the bucket cylinder 34.

The main frame 19 of the boom supporting member 17 includes control valves 49 for controlling the boom cylinder 33 and bucket cylinder 34, and control levers 50 for controlling the control valves 49. Instead of the bucket 14, any other working implements (e.g. a roll grub and a fork) may be attached to the booms 13.

Figure 8:
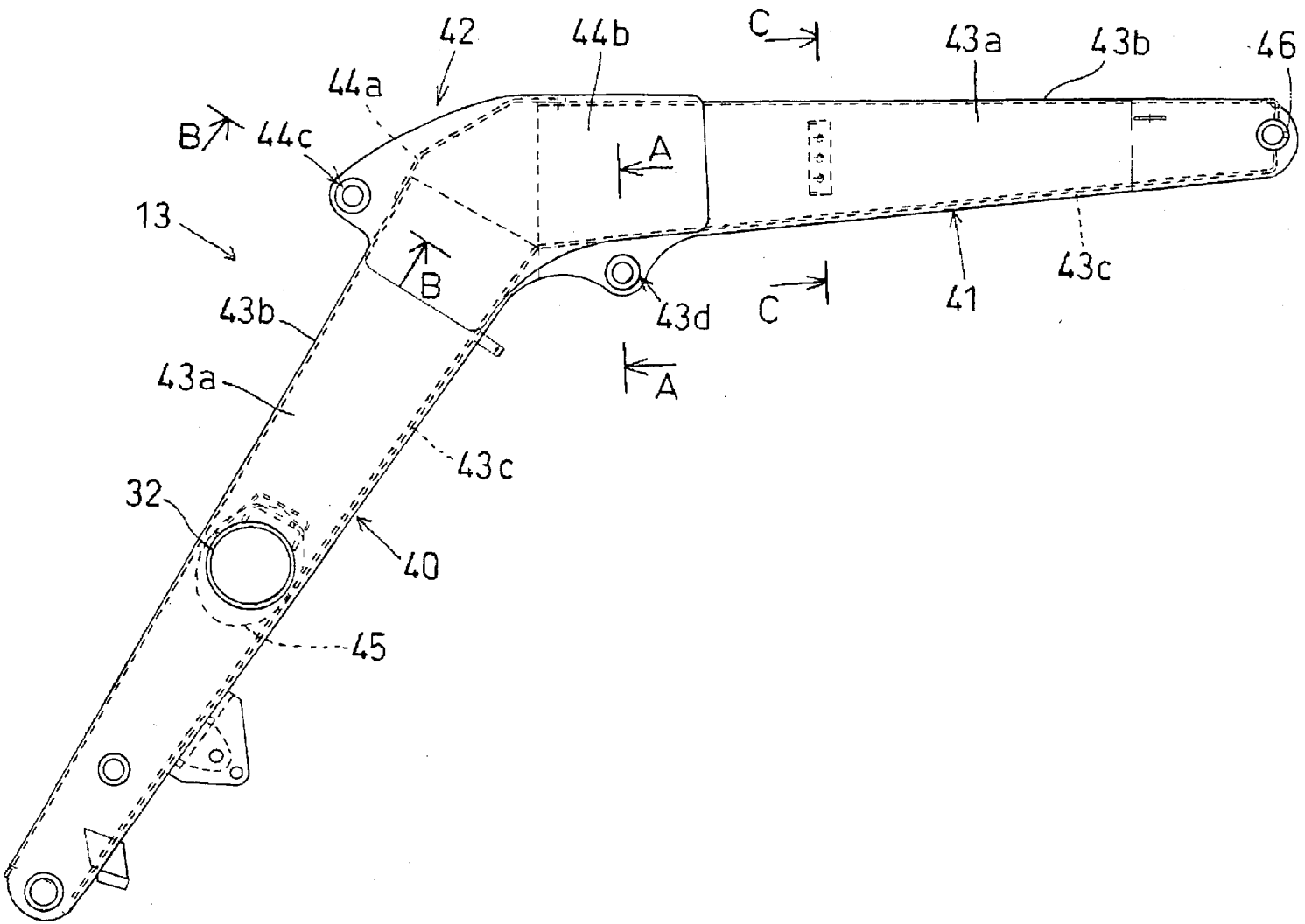
FIG. 8 is a side elevation of the boom.
Figures 9A, 9B, 9C, 9D:
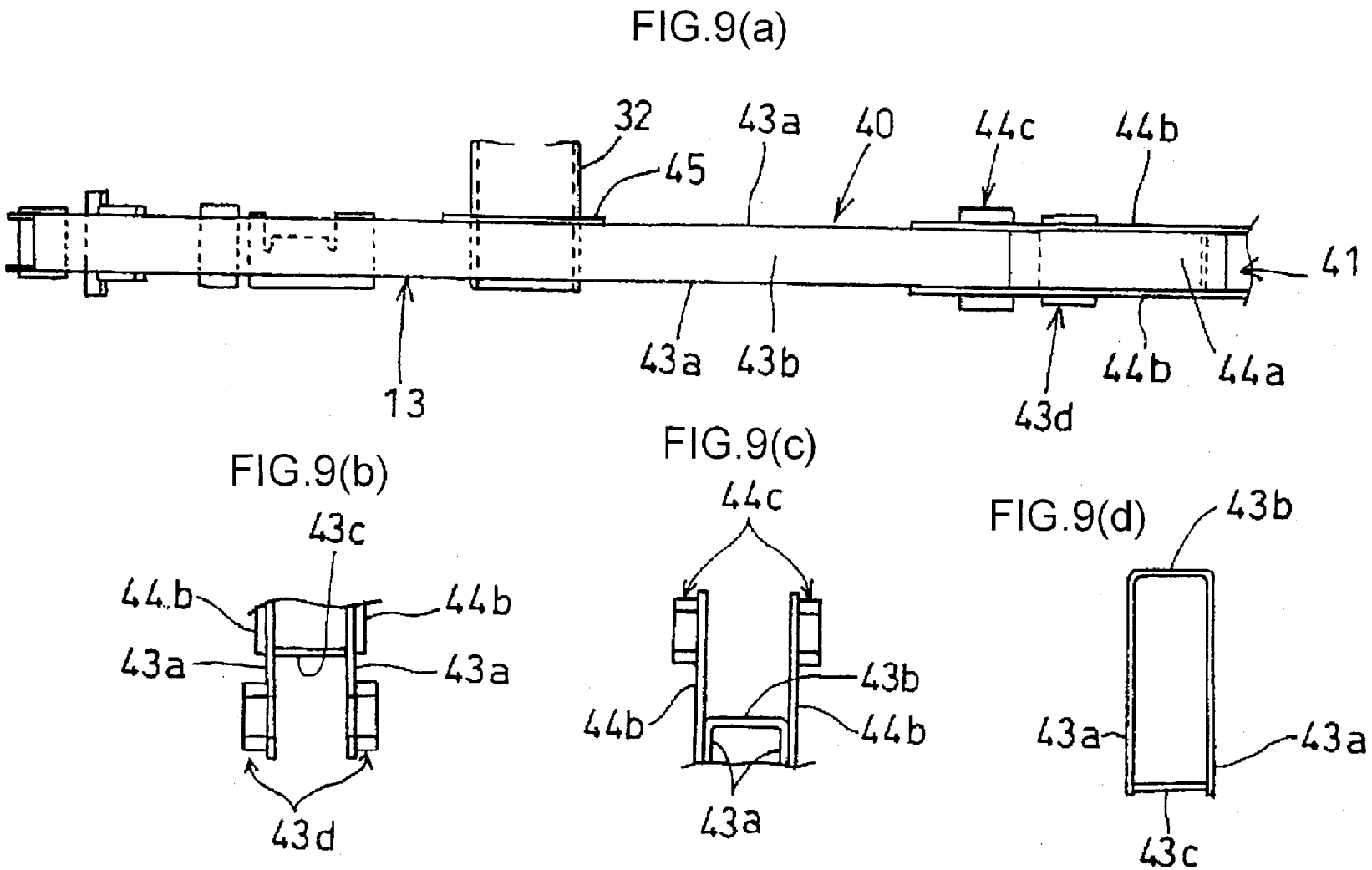
FIG. 9*a* is a plan view of a forward portion of a left boom.
FIG. 9*b* is a sectional view taken on line A—A of FIG. 8.
FIG. 9*c* is a sectional view taken on line B—B of FIG. 8.
FIG. 9*d* is a sectional view taken on line C—C of FIG. 8.

As shown in FIGS. 8 and 9, the boom 13 includes a forward component 40, a rearward component 41 and an intermediate component interconnecting the forward and rearward components.

Each of the forward component 40 and rearward component 41 includes a pair of right and left side walls 43*a*, an upper wall 43*b* disposed between upper portions of the side walls 43*a*, and a bottom wall 43*c* disposed between lower portions of the side walls 43*a*, thereby to define a box-like configuration rectangular in section.

The right and left side walls 43*a* and the upper wall 43*b* are integrally formed by bending a plate member to a channel shape, while the bottom wall 43*c* is formed by a plate member bridging and welded to the lower portions of the side walls 43*a*.

The intermediate component 42 includes an upper connecting plate 44*a* for interconnecting the upper walls 43*b* of the forward component 40 and rearward component 41, and side connecting plates 44*b* for interconnecting the side walls 43*a* of the forward component 40 and rearward component 41. The forward and rearward bottom walls 43*c* are joined end to end to each other by welding.

Each of the side connecting plates 44*b* has a front portion protruding upward from the upper wall 43*b* of the forward component 40. A pivotal support 44*c* is formed on the protruding portion for pivotally supporting the proximal end of the bucket cylinder 34. On the other hand, each of the side walls 43*a* of the rearward component 41 has a front portion protruding downward from the bottom wall 43*c* thereof. A pivotal support 43*d* is formed on the protruding portion for pivotally supporting the proximal end of the boom cylinder 33.

In a conventional boom, the upper connecting plate 44*a* is extended rearward at an upper face of the upper wall 43*b* of the rearward component 41, while an additional reinforcing plate is attached to an upper face of the upper wall 43*b* of the forward component 40. In this embodiment, however, the upper connecting plate 44*a* has forward and rearward portions thereof slightly overlapping the forward and rearward upper walls 43*b*, respectively. This dispenses with other reinforcing elements, thereby to simplify the construction.

Further, a side plate 45 having an elliptical shape in side view is secured to an inner surface of the forward component 40 around the connecting pipe 32.

The conventional boom provides a reinforcing plate between the upper wall 43*b* of the forward component 40 and an upper face of the connecting pipe 32, which increases the number of parts and complicates the construction. This embodiment dispenses with such a reinforcing plate and provides the above-noted side plate 45 to increase the thickness of the connection between the connecting pipe 32 and the side walls 43*a*, thereby to enhance the strength and simplify the construction.

Figure 10:
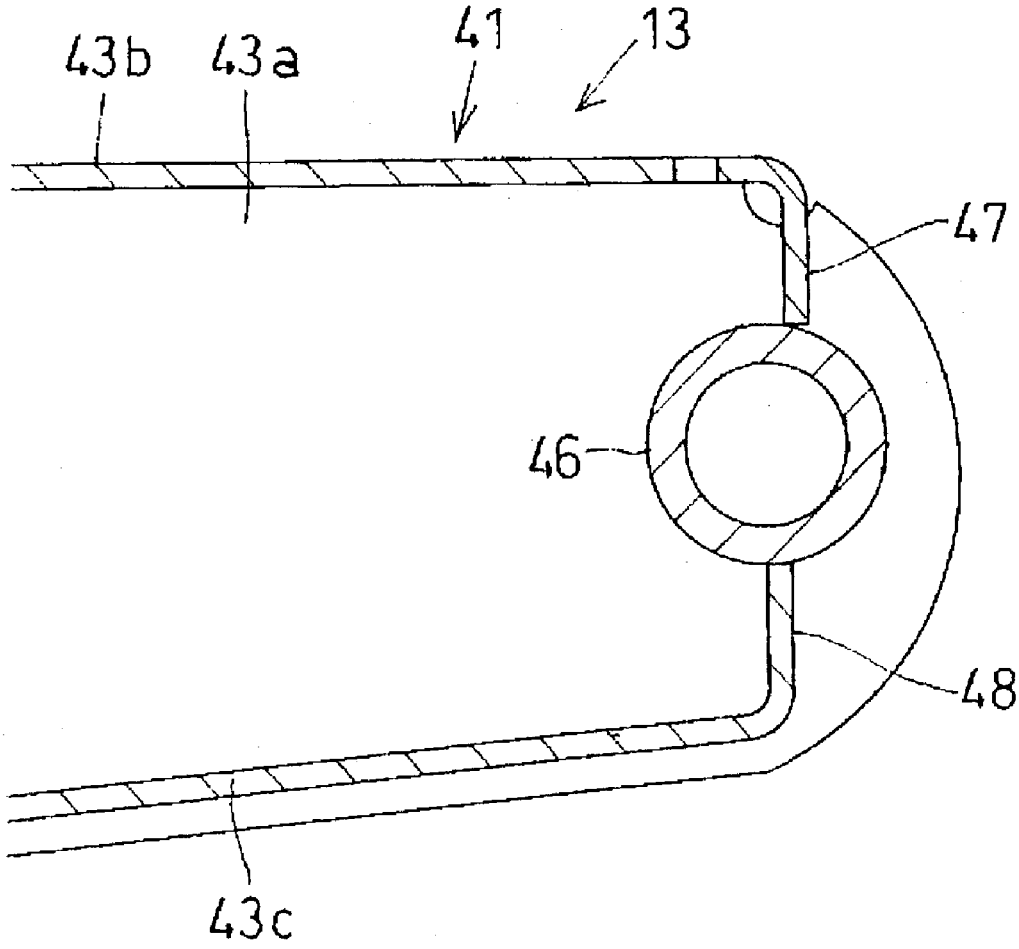
FIG. 10 is a sectional side view of a rear end portion of the boom.
Figure 11:
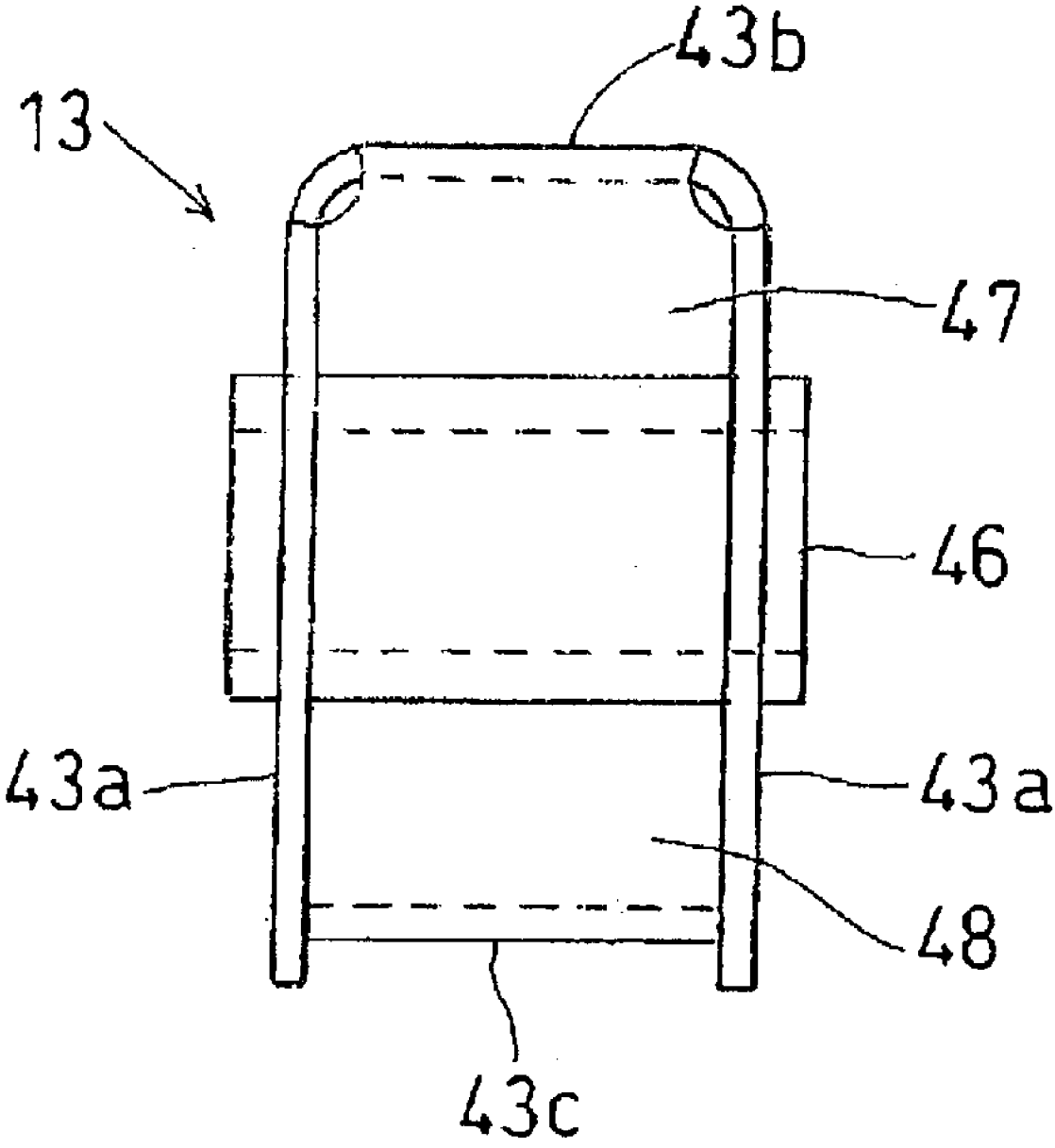
FIG. 11 is a rear view of the rear end portion of the boom.

FIGS. 10 and 11 show a construction of the pivotal support (rear end) of the boom 13 connected to the boom supporting member 17. The right and left side walls (first walls) 43*a* and the upper wall (second wall) 43*b* are formed integrally with each other by bending the plate into the channel shape. The bottom wall (second wall) 43*c* is formed separately from these side and upper walls and joined thereto by welding.

A tubular boss 46 bridges the right and left side walls 43*a* for receiving a connecting rod connected to the boom supporting member 17.

A reinforcing piece 47 is provided at a rear end of the upper wall 43*b* for interconnecting the upper wall 43*b* and boss 46.

Figure 12:
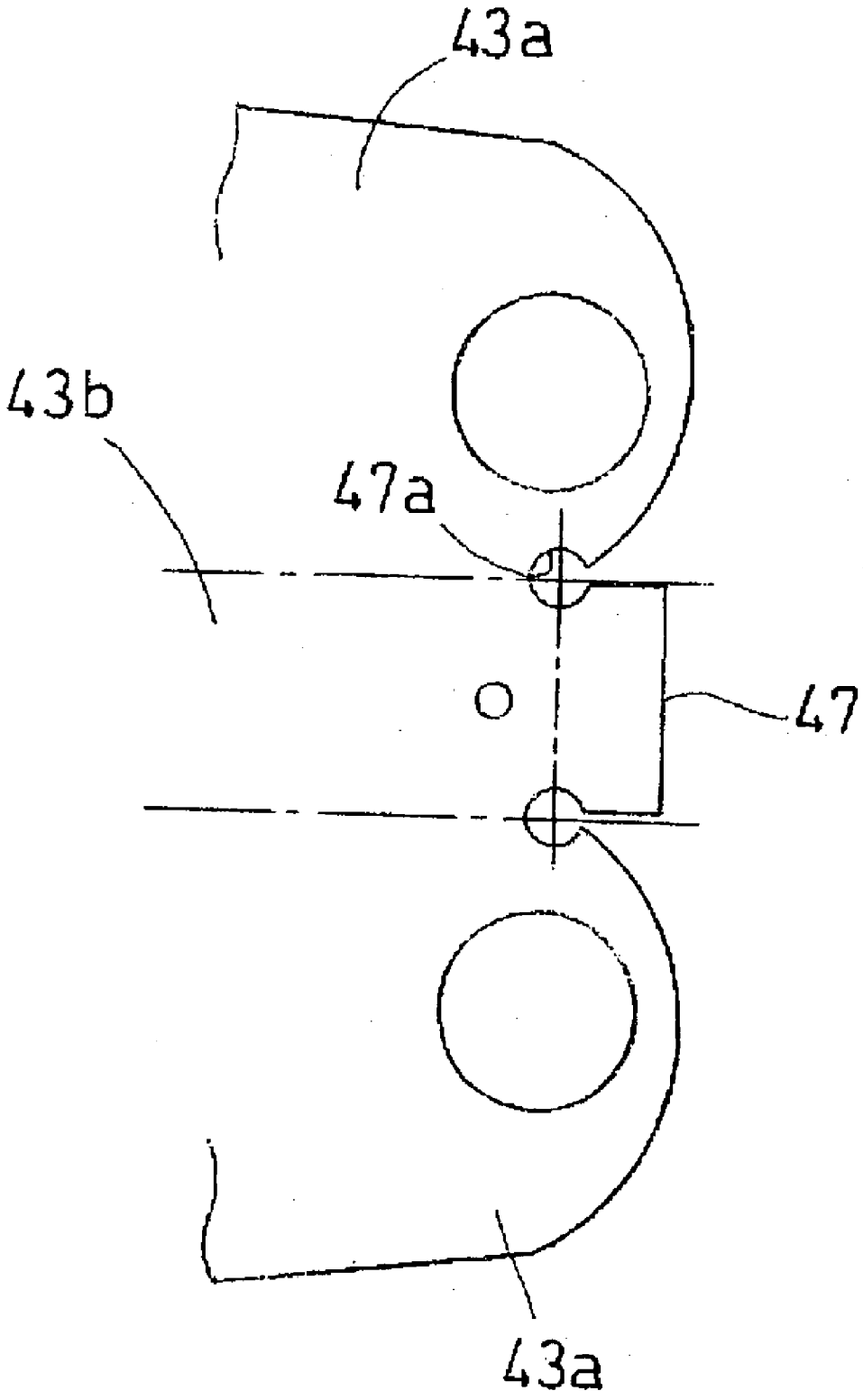
FIG. 12 is a developed view showing right and left side walls and an upper wall of the rear end portion of the boom.

As understood from FIG. 12 showing the rearward component 41 developed at an upper portion thereof, the reinforcing piece 47 is integrally formed with the upper wall 43*b* and bent at a broken line to have a bottom end thereof butting against an upper face of the boss 46 where the reinforcing piece and boss are joined together by welding.

Thus, the number of parts and manufacturing steps can be reduced, which leads to a cost reduction as compared with the reinforcing piece 47 formed as a separate element and welded to both of the upper wall 43*b* and boss 46.

Numeral 47*a* denotes bores formed between the reinforcing piece 47, side walls 43*a* and upper wall 43*b* for preventing cracking of the reinforcing piece 47 and side walls 43*a* and stress concentration at boundaries between the reinforcement piece 47 and side walls 43*a* when they are bent.

Provided also at a rear end of the bottom wall 43*c* is a reinforcing piece 48 for interconnecting the bottom wall 43*c* and boss 46. The reinforcing piece 48 is integrally formed with the bottom wall 43*c* and bent to butt against and welded to a lower surface of the boss 46.

In this case also, the number of parts and manufacturing steps can be reduced, which leads to a cost reduction as compared with the reinforcing plate 48 formed separately from the bottom wall 43*c*.

In the above-described construction, only one of the reinforcing pieces 47 and 48 may be integrally formed with the upper walls 43*b* or the bottom wall 43*c* (the other of the reinforcing pieces may be separate from and welded to the upper wall 43*b* or the bottom wall 43*c*). Alternatively, the four walls 43*a*, 43*b* and 43*c* may be formed by bending a single plate. Further, the boom 13 may define an octagonal section by modifying corners of the rectangular section to have inclined planes.

As shown in FIGS. 1 and 2, a front guard 51 is provided forwardly of a front grille of the tractor 2 for protecting a front surface of the tractor 2.

Figure 13:
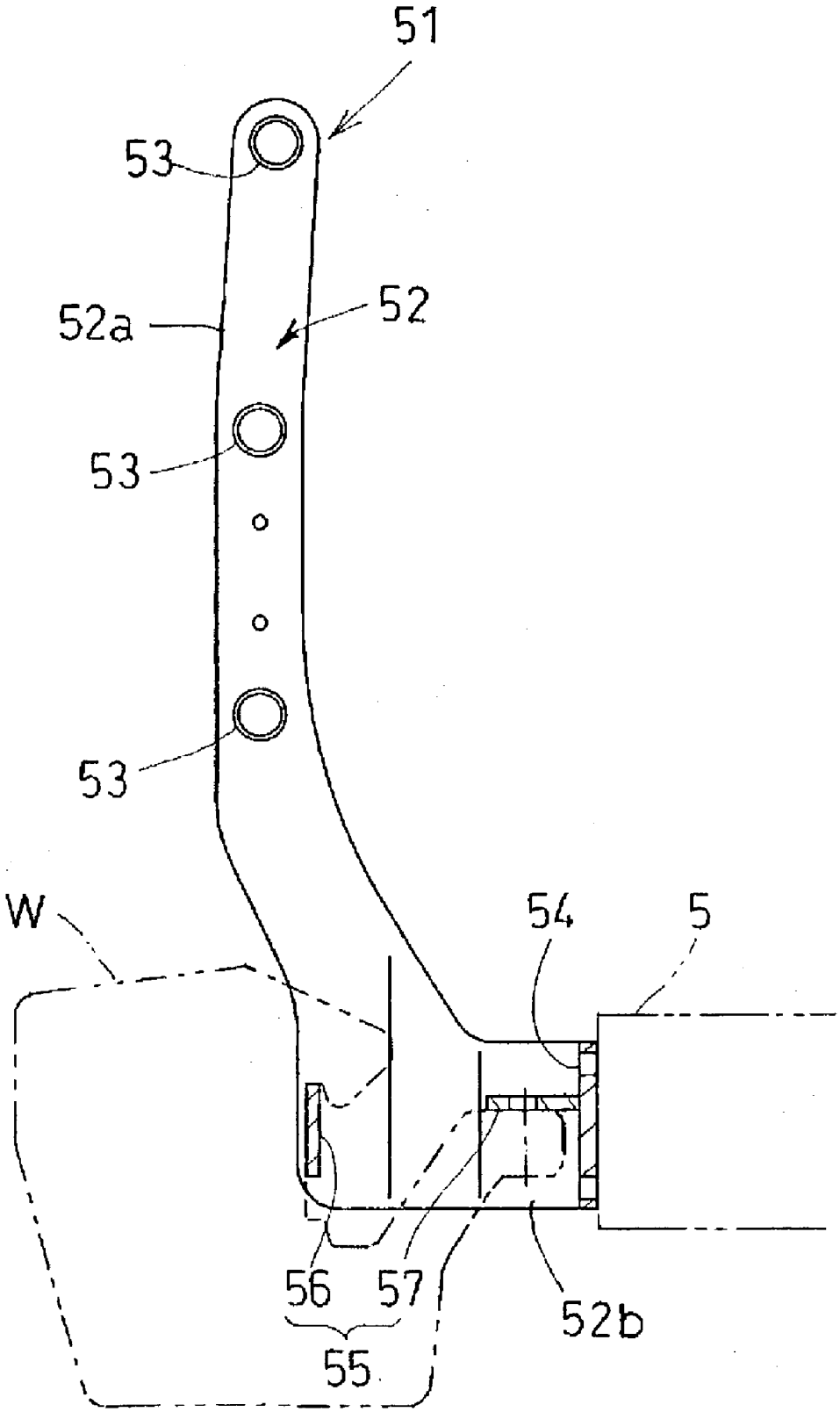
FIG. 13 is a sectional side view of a front guard.
Figure 14:
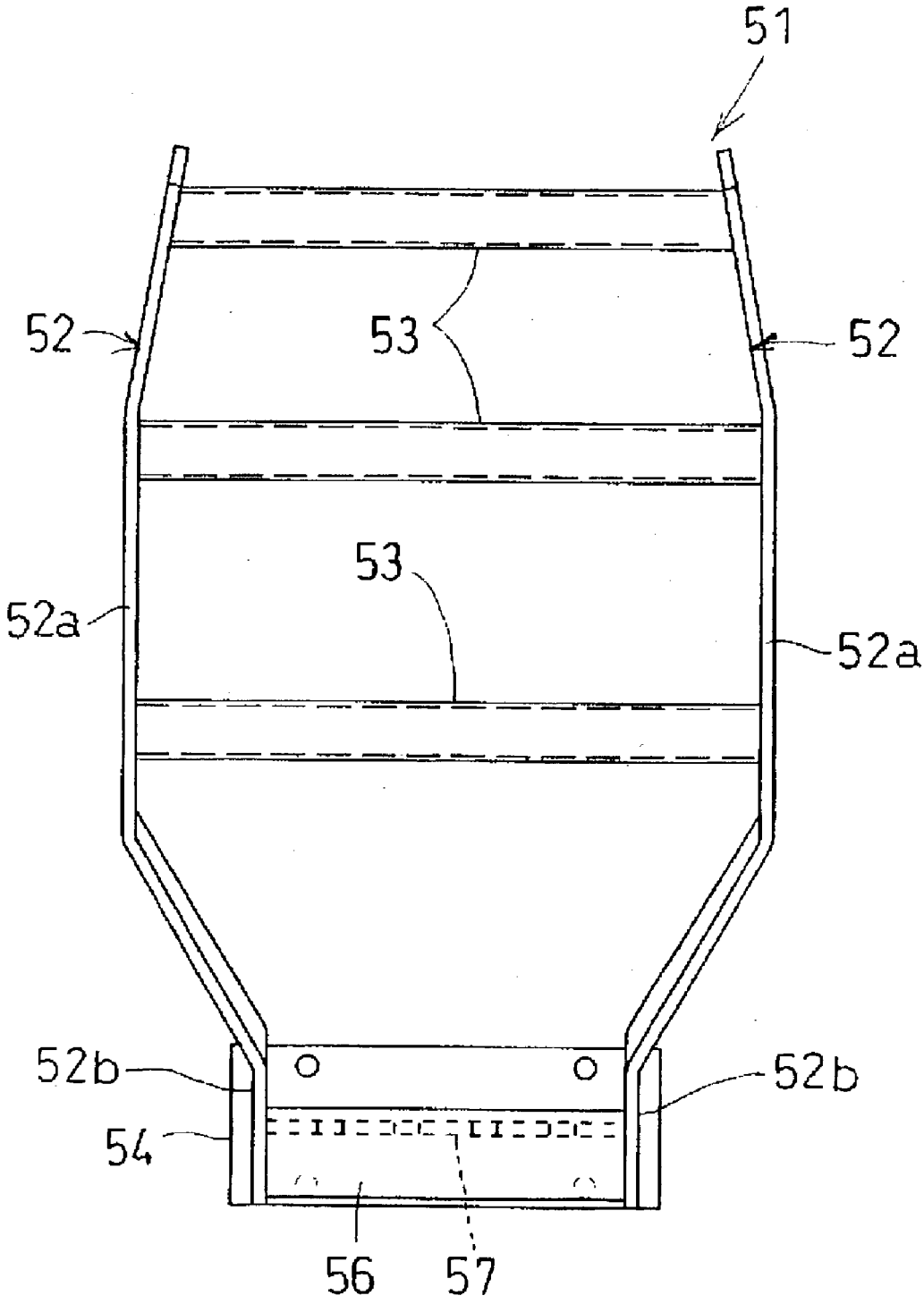
FIG. 14 is a front view of the front guard.

As specifically shown in FIGS. 13 and 14, the front guard 51 includes a right and left vertically elongated side frame members 52, cross frame members 53 extending between the side frame members 52, and a mounting plate 54 for connecting the side frame members 52 to the front axle frame 5.

Each side frame member 52 has a vertically extending main portion 52*a* and a rearwardly extending portion 52*b* extending rearwardly from a lower end of the main portion 52*a*. The mounting plate 54 is secured to a rear end of the rearwardly extending portion 52*b*.

The side frame member 52 bulges (bends) laterally outwardly at a vertical intermediate portion in front view, and the rearwardly extending portion 52*b* is wider than the main portion 52*a* in side view.

The cross frame members 53 (three in the drawings) are arranged at substantially regular intervals between the main portion 52*a*.

When any other working implements are attached to the rear end of the tractor 2, a weight may be mounted forwardly of the tractor 2 in order to keep a fore and aft balance. The front guard 51 of the present invention includes a device 55 formed integrally therewith for attaching a weight W.

Thus, it is unnecessary to remove the front guard 51 from the tractor 2 to be replaced by a weight mounting bracket. The weight W may be attached without detaching the front guard 51.

The weight attaching device 55 includes forward and rearward connecting plates 56 and 57 extending between lower portions of the right and left side frame members 52. The forward connecting plate 56 is provided in vertical posture at front ends of the side frame members 52 to engage the weight W, while the rearward connecting plate 57 is provided in horizontal posture to butt against a front surface of the mounting plate 54 to hold a rear portion of the weight W from above.

Thus, the weight attaching device 55 is formed of the connecting plates 56 and 57 bridging the right and left frame members 52 to have a function to reinforce the front guard 51. Conversely, the connecting plates 56 and 57 provided as reinforcing elements for the front guard 51 are used to form the weight attaching device 55. As a result, the number of parts is reduced to realize a lightweight construction and cost reduction.

Particularly, the rearward connecting plate 57 is placed to butt against and welded to the mounting plate 54 to form a substantially T-shaped combination, which strengthens the construction around the proximal portion of the front guard 51 connected to the front axle frame 5.

The connecting plates 56 and 57 are provided within a range of side faces of the side frame members 52 so as not to protrude forwardly of the side frame members 52. These connecting plates 56 and 57 are also provided rearwardly of the cross members 53. Thus, the weight W attached to these plates protrudes only by a reduced amount from the front guard 51.

The number of the cross frame members 53 is not limited to the above (three) but may be varied. For example, only one cross frame member 53 may bridge upper portions of the right and left side frame members 52. In this case, it is possible to form the cross frame member 53 integrally with the side frame members 52 by bending a plate.

What is claimed is:

1. A working vehicle with a front-end loader, comprising:

a vehicle body;

a right and left pair of support decks each extending transversely of the vehicle body and fixed at an inward end thereof to the vehicle body;

boom supporting members each erected on an outward end of one of the support decks;

a boom pivotably connected at one end thereof to upper positions of the boom supporting members and having a working implement attached to the other end thereof;

a boom cylinder extending between one of the boom supporting members and the boom for swinging the boom;

mounting elements each provided for one of the boom supporting members and partially protruding outward from the one of the boom supporting members; and connecting frames each fixed at one end thereof to the vehicle body and fixed at the other end thereof to one of the mounting elements, wherein the boom supporting member includes a main frame fixed to the support deck and a sub-frame detachably attached to the main frame, and wherein the boom includes a boom pivotal supporting portion connected to the sub-frame through a pin, the boom pivotal supporting portion having:

(a) a pair of first walls opposed to each other, (b) second walls provided between the first walls, (c) a boss portion bridging the pair of first walls, and (d) reinforcing pieces integrally formed with the second walls at end portions thereof and bent from the second walls toward the boss portion.

2. A working vehicle as claimed in claim 1, wherein the outwardly protruding portion of the mounting element protrudes downwardly of the boom supporting member.

3. A working vehicle as claimed in claim 2, wherein the boom supporting member includes a right and left pair of side walls, and wherein the mounting element is formed as a lower end portion of at least one of the right and left side walls.

4. A working vehicle as claimed in claim 1, wherein the support deck is a pipe element having a greater thickness than a plate member constituting the boom supporting member.

5. A front-end loader mounted on a working vehicle, comprising:

a right and left pair of support decks each extending transversely of a vehicle body of the working vehicle and fixed to the vehicle body at an inward end thereof;

a boom having a working implement attached to one end thereof; and boom supporting members each erected on an outward end of one of the support decks, each boom supporting member including a main frame fixed to one of the support decks and a sub-frame detachably attached to the main frame, wherein the boom includes a boom pivotal supporting portion connected to the sub-frame through a pin, the boom pivotal supporting portion having;

(a) a pair of first walls opposed to each other, (b) second walls provided between the first walls, (c) a boss portion bridging the pair of first walls, and (d) reinforcing pieces integrally formed with the second walls at end portions thereof and bent from the second walls toward the boss portion.

6. A front-end loader as claimed in claim 5, wherein the pair of first walls are integrally formed with one of the second walls by bending a plate element, and wherein the one of the second walls is integrally formed with one of the reinforcing pieces at an end portion thereof.

7. A working vehicle with a front-end loader, comprising:

a vehicle body;

a right and left pair of support decks each extending transversely of the vehicle body and fixed at an inward end thereof to the vehicle body;

boom supporting members each erected on an outward end of one of the support decks;

a boom pivotably connected at one end thereof to upper positions of the boom supporting members and having a working implement attached to the other end thereof;

a boom cylinder extending between one of the boom supporting members and the boom for swinging the boom;

mounting elements each provided at a lower end of a corresponding one of the boom supporting members, each mounting element protruding downwardly of the one of the boom supporting members; and connecting frames each fixed at one end thereof to the vehicle body and fixed at the other end thereof to a corresponding one of the mounting elements at the downward protrusion so that each boom supporting member and the vehicle body are interconnected through the mounting element and the connecting frame.

8. A working vehicle as claimed in claim 7, wherein each mounting element is directly surface-connected at the downward protrusion with the corresponding one of the connecting frames.

9. A working vehicle as claimed in claim 8, wherein, in a transverse direction of the vehicle body, an inner lateral face of the mounting element is connected with an outer lateral face of the connecting frame.

10. A working vehicle as claimed in claim 7, wherein the boom supporting member includes a right and left pair of side walls, and wherein the mounting element is integrally formed as a lower end portion of at least one of the right and left side walls.

11. A working vehicle as claimed in claim 7, wherein the support deck is a pipe element having a greater thickness than a plate member constituting the boom supporting member.

12. A working vehicle as claimed in claim 7, wherein the boom supporting member includes a main frame fixed to the support deck and a sub-frame detachably attached to the main frame, and wherein the boom includes a boom pivotal supporting portion connected to the sub-frame through a pin, the boom pivotal supporting portion having:

(a) a pair of first walls opposed to each other, (b) second walls provided between the first walls, (c) a boss portion bridging the pair of first walls, and (d) reinforcing pieces integrally formed with the second walls at end portions thereof and bent from the second walls toward the boss portion.

* * * * *